US006089312A

United States Patent [19]

Biar et al.

[11] Patent Number: 6,089,312

[45] Date of Patent: Jul. 18, 2000

[54] VERTICAL FALLING FILM SHELL AND TUBE HEAT EXCHANGER

[75] Inventors: Mark R. Biar; Charles J. Hammack, both of Houston, Tex.

[73] Assignee: Engineers and Fabricators Co., Houston, Tex.

[21] Appl. No.: 09/103,746

[22] Filed: Jun. 24, 1998

Related U.S. Application Data

[60] Provisional application No. 60/088,174, Jun. 5, 1998.

[51] Int. Cl.[7] ..... H23C 3/04

[52] U.S. Cl. ..... 165/118; 165/159; 165/115

[58] Field of Search ..... 165/115, 118, 165/159, DIG. 172, DIG. 19; 261/153; 29/890.03

[56] References Cited

U.S. PATENT DOCUMENTS

| | | | |
|---|---|---|---|
| 596,874 | 1/1898 | Hand | 165/159 |
| 828,060 | 8/1906 | Schwager | 165/118 |
| 3,301,320 | 1/1967 | Huntington | 165/159 |
| 3,318,588 | 5/1967 | Russell et al. | 261/153 |
| 4,136,736 | 1/1979 | Small | 165/162 |
| 4,342,360 | 8/1982 | Gentry et al. | 165/67 |
| 4,519,448 | 5/1985 | Allo et al. | 165/118 |
| 4,520,866 | 6/1985 | Nakajima et al. | 165/115 |
| 4,532,985 | 8/1985 | Cutler | 165/118 |
| 4,561,461 | 12/1985 | Hubert et al. | 137/561 A |
| 4,564,064 | 1/1986 | Allo et al. | 165/118 |
| 4,572,287 | 2/1986 | Allo et al. | 165/118 |
| 4,614,229 | 9/1986 | Oldweiler | 165/118 |
| 4,633,940 | 1/1987 | Gentry et al. | 165/159 |
| 4,641,706 | 2/1987 | Haynie | 165/118 |
| 4,810,327 | 3/1989 | Norrmen | 159/13.3 |
| 4,857,144 | 8/1989 | Casparian | 159/13.2 |
| 4,918,944 | 4/1990 | Takahashi et al. | 62/471 |
| 4,925,526 | 5/1990 | Havukainen | 159/13.3 |
| 4,932,468 | 6/1990 | Ayub | 165/118 |
| 4,991,648 | 2/1991 | Margari et al. | 165/159 |
| 5,004,043 | 4/1991 | Mucic et al. | 165/118 |
| 5,255,737 | 10/1993 | Gentry et al. | 165/159 |
| 5,472,044 | 12/1995 | Hall et al. | 165/115 |
| 5,561,987 | 10/1996 | Hartfield et al. | 62/471 |
| 5,588,596 | 12/1996 | Hartfield et al. | 239/542 |
| 5,624,531 | 4/1997 | Knuutila et al. | 159/13.3 |
| 5,649,426 | 7/1997 | Kalina et al. | 60/649 |
| 5,893,410 | 4/1999 | Halbrook | 165/118 |

OTHER PUBLICATIONS

R.Smith, J. Ranasinghe, D. States and S. Dykas, "Kalina Combined Cycle Performance and Operability," ASME Joint International Power Generation Conference, Houston, Texas, Oct., 1996.

*Primary Examiner*—Ira S. Lazarus
*Assistant Examiner*—Terrell McKinnon
*Attorney, Agent, or Firm*—Akin, Gump, Strauss, Hauer & Feld

[57] ABSTRACT

The present invention provides a vertical falling film shell and tube heat exchanger, where the falling film is formed on the exterior surface of the tubes. A distribution plate is provided below an upper tubesheet, and a sparger plate having sparger holes is provided between the upper tubesheet and the distribution plate. A plurality of vertical, parallel tubes pass through the distribution and sparger plates and are sealingly engaged with the upper tubesheet and the sparger plate. The distribution plate has oversized holes through which the tubes pass, an annular space being defined around each tube where the tube passes through the distribution plate. The first fluid passes one time through the tubes, and the second fluid is fed to the shell side as two streams, a liquid stream and a vapor stream. The liquid stream is introduced to the shell between the upper tubesheet and the sparger plate and drains downwardly onto the second distribution plate through the sparger holes. The liquid stream forms a falling film on the tubes as the liquid passes through the annular space around each tube. The vapor stream is introduced to the shell below the distribution plate and is condensed/absorbed into the falling film.

28 Claims, 3 Drawing Sheets

VERTICAL FALLING FILM SHELL AND TUBE HEAT EXCHANGER

CROSS-REFERENCE TO RELATED APPLICATIONS

This application claims the benefit of and priority to U.S. Provisional Application Ser. No. 60/088,174, filed Jun. 5, 1998, for which the inventors and title are the same as for the present patent application.

STATEMENT REGARDING FEDERALLY SPONSORED RESEARCH

Not applicable.

BACKGROUND OF THE INVENTION

1. Field of the Invention

This invention pertains to a heat transfer apparatus and process, and in particular, to a vertically oriented shell and tube heat exchanger and a process using a falling film on the exterior surface of the tubes.

2. Description of the Related Art

Vertical, falling film shell and tube heat exchangers have been used, for example, as evaporators and crystallizers in applications for providing potable water from salt water and for concentrating fruit and vegetable juices. In many of the applications for vertical falling film heat exchangers, the falling film is formed on the inside of the tubes. However, there are some applications where the falling film is formed on the outside of the tubes.

U.S. Pat. No. 4,519,448, issued to Allo et al., discloses, for use in concentrating fruit and vegetable juices, a vertical, falling film heat exchanger having a liquid distribution member surrounding each tube. The liquid distribution member has an inverted cone shape and is sealed around the tube. A plurality of holes are provided around a horizontal circumference of the distribution member so that liquid passes through the holes, contacts the exterior surface of the tube and flows as a film down the tube.

Vertical falling film shell and tube heat exchangers are finding application in the Kalina cycle used in the power industry. While the Rankine cycle uses water and steam in a thermodynamic cycle, the Kalina cycle uses a multicomponent fluid, such as a mixture of ammonia and water. In this and many other applications, it is desirable to distribute a liquid to each tube so that a film having a uniform thickness is formed on the exterior surface of each and every tube. However, in many applications the liquid loading to the heat exchanger can be low, which makes it difficult to provide a uniform film for each tube.

The heat exchanger disclosed by Allo et al. is believed to not work very well for a low liquid loading because the open area for liquid flow is relatively large. Further, it is too expensive to make a heat exchanger having an individual liquid distribution member for each tube, where some applications require about 5,000 tubes.

SUMMARY OF THE INVENTION

The present invention provides a vertical, falling film shell and tube heat exchanger having a shell and a plurality of tubes within the shell. An upper tubesheet is secured within the shell for receiving the tubes in sealing engagement. A distribution plate is received within the shell below the upper tubesheet and has oversized holes through which the tubes pass. An annular space is defined around each tube where the tube passes through the distribution plate. A sparger is received within the shell between the distribution plate and the upper tubesheet, and the shell has a liquid inlet that is in fluid communication with the sparger. The sparger is preferably a plate having sparger holes. A shell-side liquid can be fed through the liquid inlet into the sparger, the liquid flowing downwardly through the sparger holes onto the distribution plate and then downwardly through the annular space around each tube, forming a falling film on the tubes. In a preferred embodiment the shell has a vapor inlet below the distribution plate, and vapor can be condensed and/or absorbed into the falling film.

In another aspect the present invention provides a process for exchanging heat between first and second fluids using a vertical, falling film shell and tube heat exchanger. The process includes the steps of passing the first fluid through a plurality of tubes while passing the second fluid through a shell surrounding the tubes. The second fluid is fed into a sparger located within the shell that distributes the second fluid to a distribution plate. The distribution plate has oversized holes through which the tubes pass and a falling film is formed on the tubes as the second fluid flows downwardly onto the tubes through an annular space around the tubes within the oversized holes. Preferably, the second fluid contains at least two components and is split into a liquid stream and a vapor stream. The vapor stream is fed into the shell below the distribution plate and is condensed and/or absorbed into a falling film of the liquid stream on the tubes.

BRIEF DESCRIPTION OF THE DRAWINGS

A better understanding of the present invention can be obtained when the following detailed description of the preferred embodiment is considered in conjunction with the following drawings, in which.

DETAILED DESCRIPTION OF INVENTION

Figure 1:
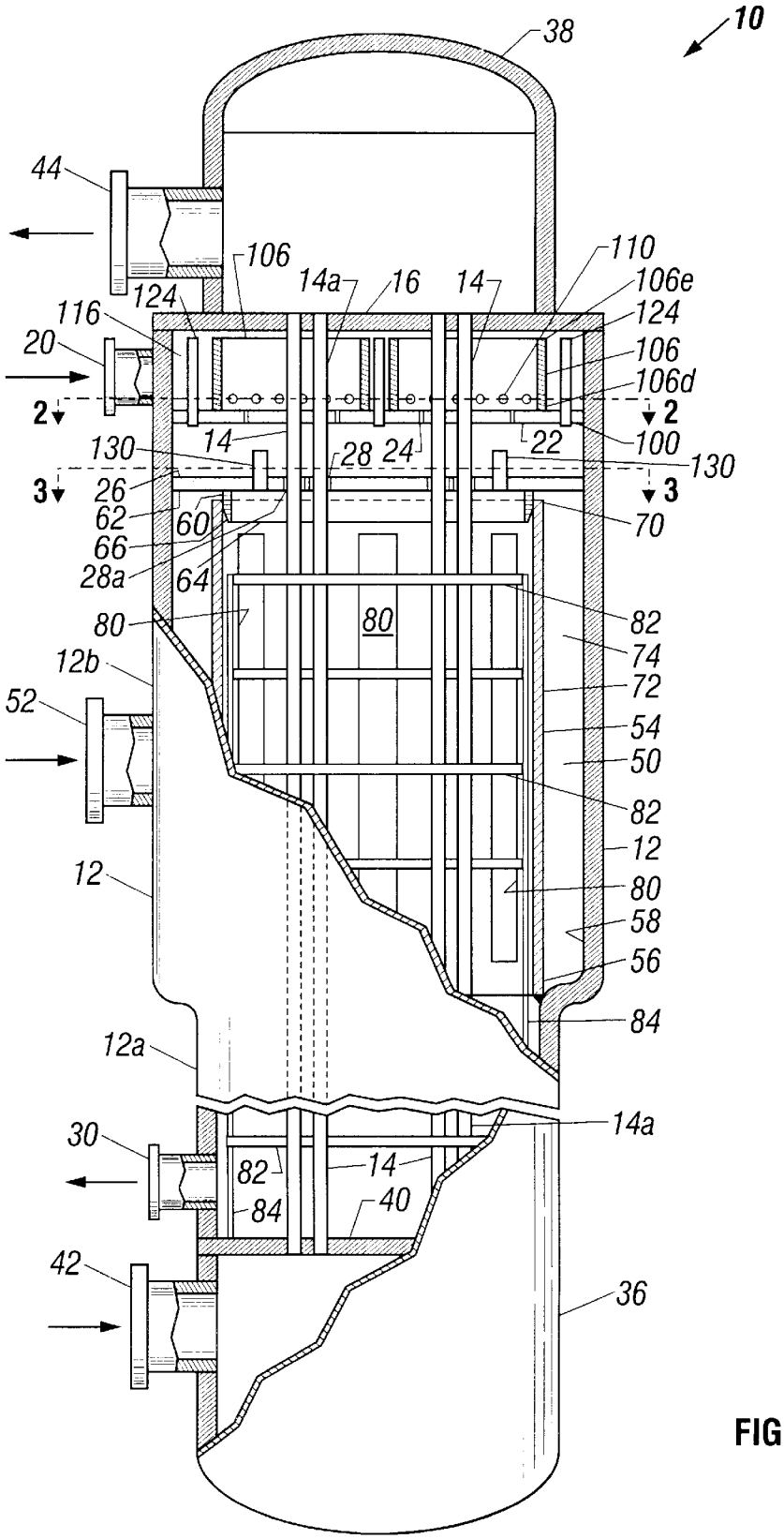
FIG. 1 is an elevational view, partially in section, of one embodiment of a falling film heat exchanger according to the present invention.

With reference to FIG. 1, a vertical, falling film shell and tube heat exchanger 10 has a shell 12 and a plurality of tubes 14. Shell 12 has a lower portion 12*a* and an enlarged upper portion 12*b* for use in fluid distribution as explained further below. Tubes 14 are received in an upper tubesheet 16. Shell 12 has an inlet 20 in fluid communication with a sparger 22. Sparger 22 has sparger holes 24, and a distribution plate 26 is secured within shell 12. Distribution plate 26 has oversized holes 28 through which tubes 14 pass. Liquid is received within the shell through inlet 20, where it flows through sparger holes 24 onto distribution plate 26. The liquid flows through oversized holes 28, forming a falling film on tubes 14.

Shell 12 has an outlet nozzle 30 through which the falling film is discharged from the shell. For tube-side connections, an inlet channel 36 is attached to lower portion 12*a* of shell 12 and an outlet channel 38 is attached to upper portion 12*b* of shell 12. A lower tubesheet 40 is secured within shell 12 and receives tubes 14. Inlet channel 36 has a tube-side inlet nozzle 42, and outlet channel 38 has a tube-side outlet nozzle 44.

Upper portion 12*b* of shell 12 has a vapor distribution zone 50 below distribution plate 26. Shell 12 has a vapor inlet 52 for feeding a vapor stream into vapor distribution zone 50. An inner liner 54 has a lower end 56 that is secured, typically by welding, to an inner surface 58 of shell 12. A ring 60 is secured, typically by welding, to a lower surface 62 of distribution plate 26. Ring 60 has a lower edge 64 and an inwardly tapered surface 66. Inner liner 54 has an upper end 70, and surface 66 is tapered inwardly so that ring 60 slides easily into inner liner 54 when distribution plate 26 is placed into shell 12. Ring 60 stabilizes upper end 70 of inner liner 54.

Inner liner 54 has an outer surface 72 and a vapor distribution space 74 is defined between outer surface 72 of inner liner 54 and inner surface 58 of shell 12. Inner liner 54 has slots 80 so that vapor can flow inwardly through slots 80 for contact with the liquid falling film on tubes 14. Bar-shaped baffles 82 form a cage having supporting members 84 that are secured to lower tubesheet 40. Baffles 82 stabilize tubes 14 to prevent their lateral movement.

Figure 2:
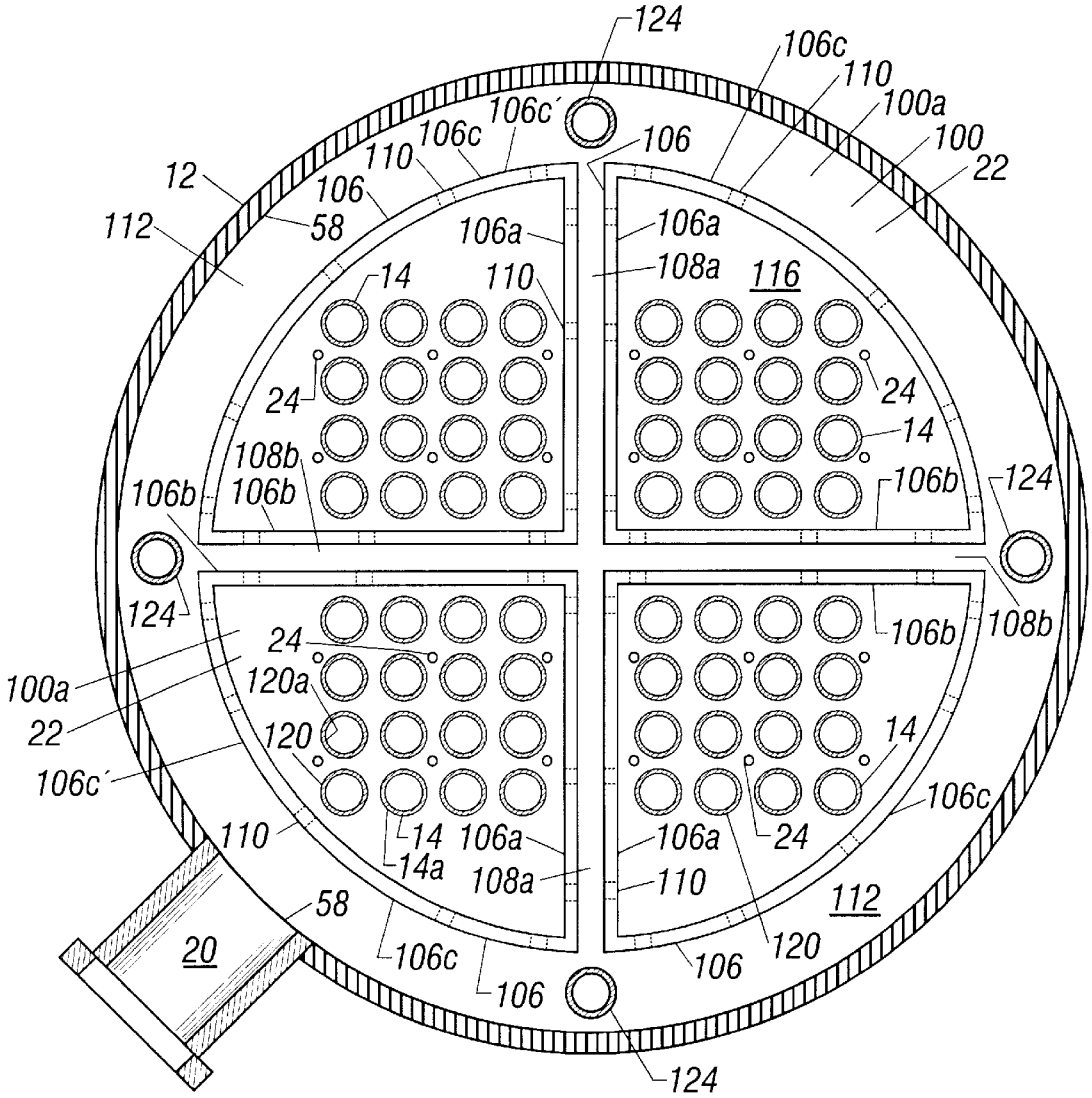
FIG. 2 is a cross-section of the heat exchanger of FIG. 1 as seen along the line 2—2 of FIG. 1.

Turning now to FIG. 2 with continuing reference to FIG. 1, sparger 22 provides a means for distributing liquid received through inlet 20 onto distribution plate 26 (FIG. 1). Sparger 22 can be any means for so distributing the liquid, such as a distributor including a perforated pipe. In the preferred embodiment illustrated in the drawings, sparger 22 includes a sparger plate 100 having an upper surface 100*a*. (Sparger plate 100 can also be referred to as a distribution plate so that with distribution plate 26, the present invention includes first and second distribution plates.) Sparger holes 24 are drilled or punched into sparger plate 100.

In this embodiment tubes 14 are spaced into quadrants, and liquid distribution shrouds 106 encircle each quadrant. (A smaller heat exchanger may not have any sections separated by shrouds while a larger heat exchanger may have more than four sections separated by shrouds. A plurality of sections can be formed by shrouds configured in various patterns for distributing fluid throughout the cross-section of the tube bundle.) Each shroud 106 includes inner sides 106*a* and 106*b* and a curved outer side 106*c*. Adjacent sides 106 a define a raceway 108*a*, and adjacent sides 106*b* define a raceway 108*b*. Shrouds 106 have holes 110 through which liquid can pass. Outer sides 106*c* have an outer surface 106*c*', and a liquid distribution space 112 is defined between outer surface 106*c*' and inner surface 58 of shell 12. Shrouds 106 have a lower end 106*d* that is secured to sparger plate 100, typically by welding. Shrouds 106 extend upwardly to an upper end 106*e* that terminates below tubesheet 16.

A liquid distribution zone 116 is defined within shell 12 between sparger plate 100 and tubesheet 16. Liquid is received through inlet 20 into liquid distribution zone 116. The liquid flows around an inner circumference of shell 12 through liquid distribution space 112. Liquid flows inwardly through raceways 108*a* and 108*b* and flows through holes 110 to cover the portion of upper surface 100*a* of sparger plate 100 that is within shrouds 106.

Liquid flows downwardly through sparger holes 24, which are preferably sized to provide a liquid head on sparger plate 100. This head is the driving force for forcing liquid through sparger holes 24 and may be typically less than about five to seven inches. Sparger plate 100 has tube holes 120 through which tubes 14 pass. Tubes 14 have an outer surface 14*a*, and sparger plate 100 has inner surfaces 120*a* that define tube holes 120. Outer surface 14*a* of tubes 14 is sealingly engaged with inner surface 120*a* of sparger plate 100, such as by contact rolling, so that liquid does not flow downwardly around outer surface 14*a* through sparger plate 100. Thus, sparger holes 24 provide the only openings for downward flow of liquid through sparger plate 100, except liquid overflow pipes 124 are provided to prevent an excessive pressure in liquid distribution zone 116.

The open area of sparger holes 24 is calculated to provide sufficient open area for an anticipated liquid loading on sparger plate 100. If this flow is exceeded and not accommodated by sparger holes 24, then the level of the liquid on sparger plate 100 will rise until the liquid overflows through overflow pipes 124 onto distribution plate 126. Sparger holes 24 are interspersed uniformly among tube holes 120 to provide a uniform distribution of liquid onto distribution plate 26.

Figure 3:
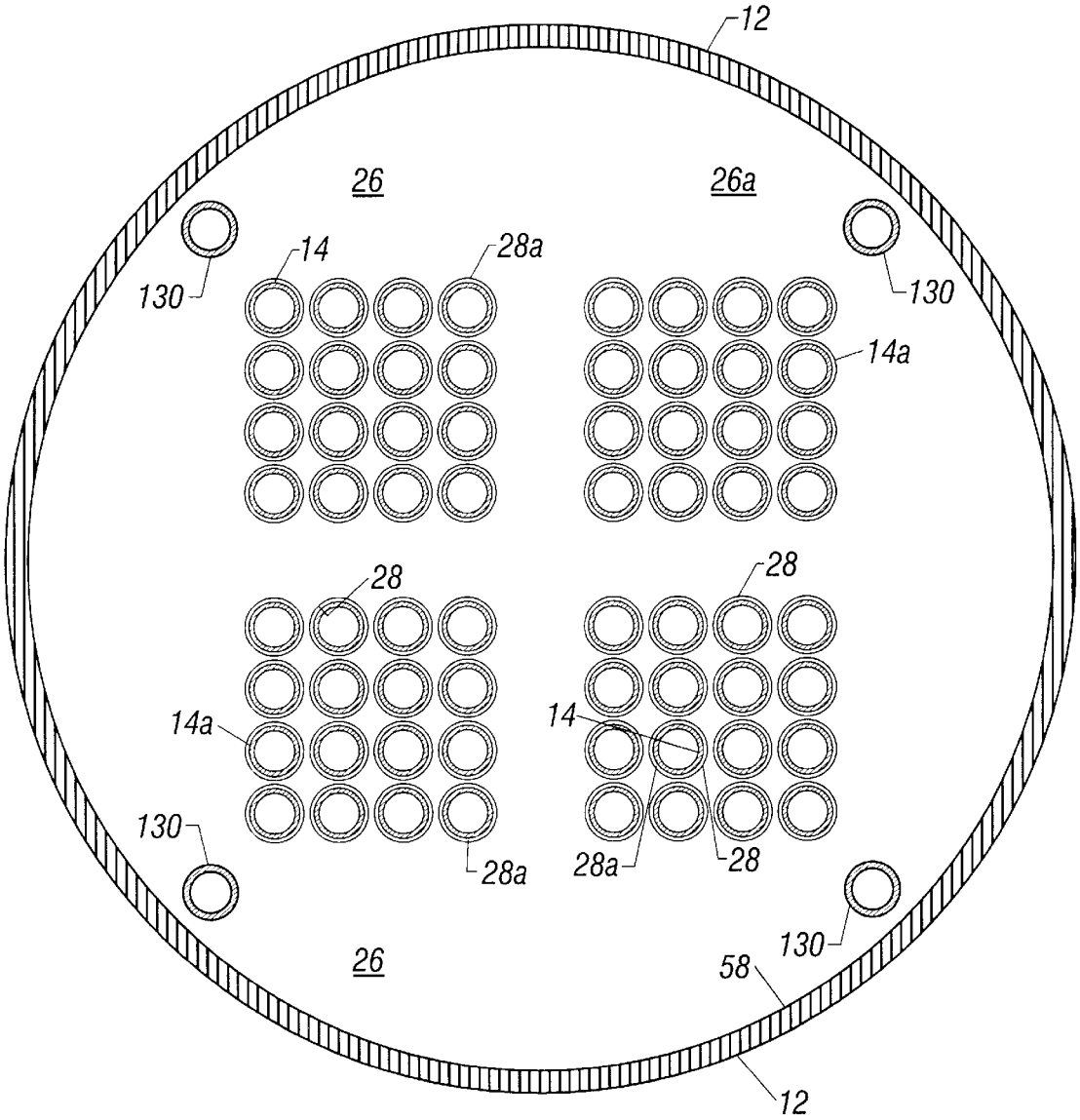
FIG. 3 is a cross-section of the heat exchanger of FIG. 1 as seen along the line 3—3 of FIG. 1.

With reference now to FIG. 3 and continuing reference to FIGS. 1 and 2, liquid flows through sparger holes 24 onto distribution plate 26 between tubes 14. Tubes 14 pass through oversized holes 28 in distribution plate 26. An annular space 28*a* is defined around each tube 14 where tube 14 passes through oversized hole 28 in distribution plate 26. Distribution plate 26 has an upper surface 26*a*, and liquid flows along upper surface 26*a* until it falls downwardly through annular space 28*a* around tube 14.

Annular space 28*a* is designed sufficiently small so that as liquid falls through annular space 28*a*, the liquid adheres to outer surface 14*a* of tube 14. Thus, a film of liquid is formed on outer surfaces 14*a* of tubes 14. The film falls downwardly along the outer surface 14*a* of tubes 14 by the force of gravity and is referred to as a falling film. Tube 14 is preferably centered in oversized hole 28 so that annular space 28*a* is uniform in thickness around tube 14. With annular space 28*a* thus having a uniform thickness, the falling film of liquid formed on outer surface 14*a* of tube 14 is uniform in thickness.

Annular space 28*a* is designed to provide sufficient open area to accommodate an anticipated liquid loading. Pressure equalization pipes 130 are provided and are in fluid communication with vapor distribution zone 50. Pressure equalization pipes 130 are provided primarily to prevent vapor from attempting to come up through annular spaces 28*a*, which would cause a maldistribution of flow through distribution plate 26. However, if an excessive level of liquid were to accumulate on distribution plate 26, then liquid can overflow through pressure equalization pipes 130. Thus, liquid can overflow downwardly through pressure equalization pipes 130 or vapor can flow upwardly from vapor distribution zone 50 through pressure equalization pipes 130. Pressure is essentially equalized above and below distribution plate 26 so that the liquid head on distribution plate 26 provides the driving force for liquid to flow through annular spaces 28*a* around tubes 14.

The present invention can be used, for example, as a heat exchanger, evaporator or crystallizer, such as for concentrating fruit and vegetable juices or for desalinizing water. Vapor inlet 52 is optional and would not be used in many of the applications for the present invention. The illustrated embodiment of the present invention is particularly well suited for use in a power plant that uses the Kalina cycle. The Kalina cycle uses a multicomponent fluid as the working fluid, typically a solution of ammonia and water. An available coolant, such as a multicomponent fluid or sea or river water, is used to condense/absorb the working fluid. Such coolants tend to foul and corrode a heat transfer surface, so the coolant passes through the tube side, which can be cleaned more easily.

In the illustrated embodiment, seawater flows into inlet channel 36 through inlet nozzle 42 and then flows through tubes 14 in one pass. The seawater discharges from tubes 14 into outlet channel 38 and exits through outlet nozzle 44. In this power plant application, a shell-side fluid is split into a liquid stream that is fed into shell 12 through inlet 20 and a vapor stream that is fed into shell 12 through vapor inlet 52. The liquid stream, which is lean in ammonia as indicated by its composition provided below, is fed into liquid distribution zone 116. The liquid stream flows through liquid distribution space 112 and into raceways 108*a* and 108*b*. The liquid stream flows through holes 110 to reach an interior portion of each shroud 106. The liquid stream then flows along upper surface 100*a* of sparger plate 100 until a sparger hole 24 is reached.

The liquid stream flows downwardly through sparger holes 24 onto distribution plate 26, runs along upper surface 26*a* of distribution plate 26, and flows downwardly through annular space 28*a* around each tube 14. A falling film of relatively uniform thickness is formed on outer surface 14*a* of tubes 14 as the liquid stream flows through annular spaces 28*a*. The falling film flows downwardly on tubes 14 since heat exchanger 10 is oriented vertically.

The vapor stream flows into vapor distribution zone 50 through vapor inlet 52. The vapor stream flows within the inner circumference of shell 12 through vapor distribution space 74. The vapor stream flows inwardly through slots 80 in inner liner 54, where the vapor stream contacts the falling film of the liquid stream on the outer surface 14*a* of tubes 14. The open area of slots 80 should be sufficiently large so that vapor velocity is low to prevent shearing the liquid falling film off of tubes 14.

To a certain extent the vapor stream is condensed, but it is believed, without being held to theory, that the vapor stream is primarily absorbed into the liquid stream that is flowing as a falling film on tubes 14. Absorption is believed to be the primary mechanism for transformation of the vapor stream into a liquid because the temperature of tubes 14 is too high to fully condense ammonia vapor at its partial pressure within shell 12. As the vapor stream is absorbed or condensed, a vacuum would be created, except additional vapor flows into that space, so that the pressure remains relatively constant.

The falling film maximizes the exposed surface area of the liquid for maximizing absorption of the ammonia vapor into the liquid. As the vapor is absorbed into the liquid, it is transformed into a liquid itself, which releases heat that is carried away by the liquid flowing on the inside of the tubes. Thus, the heat transfer process is completed regardless whether the ammonia vapor is condensed or absorbed. Under certain conditions, ammonia vapor may not be fully absorbed into the liquid falling film. Under these conditions ammonia vapor would accumulate as a noncondensible vapor or gas. An injection nozzle can be installed in the shell near outlet nozzle 30 to inject a fluid, which is lean in ammonia, to absorb the uncondensed ammonia vapor.

Vertical, falling film shell and tube heat exchanger 10 is used in the Kalina cycle because it is believed to be more efficient and cost effective than any other heat transfer apparatus for this particular application. In this application a temperature cross exists. The shell-side temperature of the working fluid crosses the tube-side temperature of the coolant fluid, meaning that the outlet temperature of the shell-side working fluid is cooler than the outlet temperature of the tube-side coolant fluid. The temperature cross between the shell-side and the tube-side temperature can be addressed by using more than one heat exchanger in series, but this increases the capital cost for the power plant because it is cheaper to make one large heat exchanger than several smaller ones.

A vertical falling film, as opposed to a horizontal falling film, shell and tube heat exchanger is preferred for several reasons. Flow should be counter current, which is more easily achieved in a vertical orientation due to the gravity controlled nature of the falling film. The liquid surface area of the falling film is preferably maximized to maximize absorption of the ammonia vapor, and the surface area of the falling film is more easily maximized in a vertical orientation. In a vertical orientation, gravity causes the liquid film to flow downwardly on the surface of the tubes, which spreads the liquid into a thin, uniform film. Further, it is desirable to keep the liquid film on the tube, and in a horizontal orientation, the liquid tends to form droplets on the underside of the tubes. These droplets can be sheared or blow off of the tube surface as vapor flows through the shell side. The shearing of liquid off the tubes is less of a problem in a vertical orientation of the tubes because there is not the same tendency to form droplets.

The present invention tends to maximize the surface area of the liquid falling film. As indicated in the example below, the liquid loading can be relatively low, and thus it is important to distribute the liquid over the entire cross-sectional area of the shell. For example, in a preliminary design, sparger holes 24 were not included in sparger plate 100, and tubes 14 were not sealed in tube holes 120 in sparger plate 100. Tube holes 120 were kept at a minimum practical size for passing the tubes through, but even this minimum size allowed too much open area through sparger plate 100. Consequently, the liquid stream would not distribute evenly over the entire cross-sectional area of sparger plate 100 and would instead flow through an annular space around relatively few tubes.

To improve liquid distribution over the entire surface of sparger plate 100, shrouds 106 are provided and tubes 14 are expanded within tube holes 120 so that tubes 14 are sealed where they pass through sparger plate 100. Raceways 108*a* and 108*b* provide a pathway for the liquid to flow into the interior of the tube bundle before the liquid flows through holes 110 in shrouds 106. Sparger holes 24 provide no more open area than is required to accommodate the anticipated liquid loading, and liquid overflow pipes 124 are provided when the liquid loading exceeds what can be handled by sparger holes 24. Thus, sparger 22 has many features for ensuring that liquid is distributed evenly throughout the entire cross-sectional area of the tube bundle.

With an even distribution of liquid flow through sparger holes 24, the liquid received on liquid distribution plate 26 is throughly distributed over the entire upper surface area of distribution plate 26. With liquid dispersed throughout the tube bundle, there is an opportunity to form a falling film on each and every tube as the liquid flows through annular space 28*a* around the tubes 14. Thus, the liquid is uniformly distributed to the various tubes 14. Annular space 28*a* is relatively small. Tube 14 should be centered within hole 28 so that annular space 28*a* has a uniform thickness around the circumference of tube 14. If annular space 28*a* has a uniform thickness, then the thickness of the falling film that forms will be more uniform.

However, even if annular space 28*a* is not entirely uniform, it is believed that the liquid falling film will be whipped and spread around on the exterior surface of the tubes. This will improve the uniformity of the thickness of the falling film and help to wet and coat the entire outer surface of the tubes. With the tubes thus uniformly wetted and coated with the falling film, the surface area of the liquid falling film will be maximized and ammonia vapor will be more readily absorbed into the liquid.

The heat exchanger of the present invention can be fabricated relatively simply, although the heat exchanger may be over sixty feet long and have around five-thousand tubes. A pipe or rolled plate having a proper diameter and wall thickness forms shell 12. Lower tubesheet 40 is welded into shell 12. Bar-shaped baffles 82 and supports 84 are welded to form a cage-like structure that is inserted into shell 12. Supports 84 are attached to lower tubesheet 40. Lower end 56 of inner liner 54 is welded to inner surface 58 of shell 12. The enlarged upper portion of shell 12 is formed in a conventional manner for forming distribution spaces 74 and 112.

Ring 60 is welded to the underside of distribution plate 26, and then distribution plate 26 is set in place so that inwardly tapered surface 66 of ring 60 engages an inner surface of inner liner 54, which stabilizes upper end 70 of inner liner 54. Distribution plate 26 and then sparger plate 100 are welded to the inner surface of shell 12. Bars are used to maintain the alignment of the tube holes, and then upper tubesheet 16 is spaced above upper ends of liquid overflow pipes 124 and shrouds 106 and welded into place. Tubes are inserted and fixed into tubesheets 16 and 40 and sparger plate 100. Inlet channel 36 and outlet channel 38 are welded into place, and with the addition of the various nozzles, the assembly is complete.

EXAMPLE

Table 1 provides data for one application of the present invention.

TABLE 1

| Parameter | Units | Shell side | Tube Side |
|---|---|---|---|
| Fluid circulated | | 88.092 wt. % $NH_3$; 11.908 wt. % $H_2O$ | Sea Water |
| Total flow rate | Lb/Hr | 289,983 | 7,451,607 |
| Vapor flow rate | Lb/Hr | 181,877 | 0 |
| Liquid flow rate | Lb/Hr | 108,106 | 7,451,607 |
| Vapor condensed/absorbed | Lb/Hr | 181,877 | 0 |
| Temperature (In:Out) | ° F. | 96.48 : 72.40 | 64.40 : 77.82 |
| Inlet pressure | psia | 121.50 | — |
| Density (Liq./Vap.) (In:Out) | $Lb/Ft^3$ | 45.55/0.3841 : 41.02/- | 63.98/- : 63.89/- |
| SP.HT.(Liq./Vap.) (In:Out) | BTU/Lb/° F. | 1.1050/0.5035 : 1.1150/- | 0.9604/- : 0.9610/- |
| Pressure drop | psi | 0.5 | 8 |
| Heat exchanged | BTU/Hr | 100,007,000 | 100,007,000 |
| Design pressure | psig | 180.0 | 100.0 |
| Design temperature (Max/Min) | ° F. | 150.0/40 | 150.0/40 |
| Surface area | $Ft^2$ | 45,280 | |
| Number of passes | | 1 | 1 |
| Inlet nozzle | In. | Liq. 6/Vap. 20 | 28 |
| Outlet nozzle | In. | 12 | 28 |
| Number of tubes | | — | 4,186 |
| Tube length | Ft. | — | 68.50 |
| Tube outside diameter | In. | — | 0.625984 |
| Tube thickness | In. | — | 0.0756 |
| Shell inside diameter | In. | 67.750 | — |

In this example, with reference to Table 1, the heat exchanged in heat exchanger 10 is 100,007,000 BTU/hr. The corrected mean temperature difference is 8.41° F. The heat transfer rate when clean is 410.33 BTU/hr-$ft^2$-°F. and is 262.62 BTU/hr-$ft^2$-°F. when in service.

The vapor entering the shell is nearly all ammonia and is 99.9 wt. % ammonia and 0.1 wt. % water. The liquid entering the shell side is lean in ammonia, but still contains 68.2 wt. % ammonia and 31.8 wt. % water. The liquid stream is pumped into the liquid distribution space at a rate of 108,106 pounds per hour and flows through about 260 three-eighths in. holes in the shrouds on the sparger plate, where the shroud holes have a total open area of 28.6 $in.^2$. The liquid flows through about 1,050 three-sixteenths in. sparger holes having a total open area of 28.13 $in^2$ and then through the annular spaces, which provide a total open area of 187.2 $in^2$, forming a falling film on the outside surface of the tubes.

The vapor stream enters the shell side at a rate of 181,877 lb/hr, and all of the vapor becomes liquid by condensation/absorption. Absorption is believed to be the primary mechanism for transforming ammonia vapor into liquid because at these tube-side temperatures and at this ammonia partial pressure, it is not believed that ammonia will condense.

The present invention thus provides a vertical, falling film shell and tube heat exchanger that is relatively simple to fabricate. It is not necessary to machine and assemble a variety of small components. This sparger plate and the distribution plate can be fabricated and assembled relatively easily.

In a power plant using the Kalina cycle, the shell-side fluid, which is a mixture of ammonia and water, is available as a split stream. Liquid lean in ammonia is pumped into the sparger where the liquid is evenly distributed and flows onto the distribution plate. The liquid is evenly distributed among the tubes and forms a falling film on each of the tubes, and the falling film is relatively uniform in thickness. Vapor flows into the vapor distribution space under its own pressure, without need for compression. Since the liquid is dispersed as a falling film on the numerous tubes, the ammonia vapor is readily condensed/absorbed into the liquid falling film. Although the mean temperature difference is typically less than about 10 to 15° F., the required duty is achieved in a single, one-pass exchanger.

The foregoing disclosure and description of the invention are illustrative and explanatory thereof, and various changes in the details of the illustrated apparatus and construction and method of operation may be made without departing from the spirit of the invention.

What is claimed is:

1. An apparatus for exchanging heat, comprising:

a shell having an inlet and an outlet;

a tubesheet secured within the shell;

a plurality of tubes engaged in the tubesheet;

a distribution plate secured within the shell and spaced apart from the tubesheet, the distribution plate having oversized holes through which the tubes pass; and a sparger spaced apart from the distribution plate, the sparger being in fluid communication with the inlet for distributing a fluid onto the distribution plate, the sparger being adapted to provide a first distribution of the fluid on the distribution plate, and the distribution plate being adapted to provide a second distribution of the fluid on the distribution plate before the fluid flows through the oversized holes in the distribution plate.

2. The apparatus of claim 1, wherein the sparger includes a perforated plate located above the distribution plate and below the tubesheet.

3. The apparatus of claim 1, wherein the sparger includes a perforated pipe located above the distribution plate and below the tubesheet.

4. The apparatus of claim 1, wherein the shell further includes a vapor inlet below the distribution plate.

5. A falling film heat exchanger, comprising:

a shell;

an upper tubesheet secured within the shell;

a plurality of vertically positioned parallel tubes, each tube being sealingly engaged in a hole in the upper tubesheet;

tube-side connections for passing a first fluid through the tubes;

a sparger plate located within the shell and spaced below the upper tubesheet, the sparger plate, the upper tubesheet and the shell defining a liquid distribution zone, the sparger plate having tube holes for passing the tubes through the sparger plate, the shell having a liquid inlet for feeding a liquid into the liquid distribution zone, the sparger plate having a plurality of sparger holes for passing the liquid through the sparger plate; and a distribution plate secured within the shell and spaced below the sparger plate, the distribution plate having oversized holes for passing the tubes through the distribution plate, an annular space being defined between a tube and the distribution plate for the liquid to flow through and form a falling film on the tube.

6. The apparatus of claim 5, wherein the sparger plate is adapted to distribute the fluid onto an upper surface of the distribution plate, and the distribution plate is adapted such that the fluid received from the sparger plate flows across the upper surface of the distribution plate before the fluid flows downward through the annular space around a tube.

7. The heat exchanger of claim 5, wherein the tubes are sealingly engaged with the sparger plate.

8. The heat exchanger of claim 5, wherein the shell has a vapor inlet for feeding vapor into the shell below the distribution plate.

9. The heat exchanger of claim 7, further comprising an inner liner, wherein a vapor distribution space is defined between the inner liner and the shell for distributing vapor.

10. The heat exchanger of claim 8, wherein the inner liner has slots through which vapor may pass.

11. The heat exchanger of claim 5, wherein the tubes are spaced into a plurality of sections and raceways are defined between the sections for passing liquid into the liquid distribution zone.

12. The heat exchanger of claim 5, wherein the shell has a lower portion and an upper portion, the upper portion having a greater diameter than the lower portion, and wherein a liquid distribution space is provided along an inner circumference of the upper portion.

13. The heat exchanger of claim 12, further comprising a liquid distribution shroud secured within the liquid distribution zone and placed between the tubes and an inner surface of the upper portion of the shell, the liquid distribution shroud having holes, the liquid distribution space being defined between the liquid distribution shroud and the upper portion of the shell.

14. The heat exchanger of claim 13, wherein the sparger plate has the tube holes arranged in a plurality of sections, the liquid distribution shroud encircling each section and defining raceways between the sections for passing liquid into the liquid distribution space.

15. A shell and tube heat exchanger for forming a falling film on exterior surfaces of tubes when used in a vertical orientation, comprising:

a shell having a cross-section, an upper portion and a lower portion;

an upper tubesheet sealingly secured within the upper portion;

a lower tubesheet sealingly secured within the lower portion;

a plurality of tubes sealingly engaged in the upper and lower tubesheets, the tubes having an outside diameter;

tube-side connections for passing a fluid through the tubes;

a distribution plate secured in the upper portion below the upper tubesheet, the distribution plate having a plurality of oversized holes, the oversized holes having a diameter greater than the outside diameter of the tubes, each tube passing through an oversized hole, an annular space being defined around the tube; and a sparger plate secured within the shell between and spaced apart from the upper tubesheet and the distribution plate, the sparger plate having a plurality of tube holes and a plurality of drain holes, one tube hole for each tube, a liquid distribution zone being defined within the shell between the upper tubesheet and the sparger plate, the shell having a liquid inlet for feeding a liquid stream into the liquid distribution zone, wherein sparger plate is adapted to provide a first distribution of liquid within the cross-section of the shell before the liquid flows through the plurality of drain holes onto an upper surface of the distribution plate, and wherein the distribution plate is adapted to provide a second distribution of liquid within the cross-section of the shell before the liquid flows through the oversized holes.

16. The heat exchanger of claim 15, wherein the tubes are sealingly engaged by the sparger plate.

17. The heat exchanger of claim 13, further comprising a pressure equalizing pipe passing through the distribution plate.

18. The heat exchanger of claim 15, wherein a vapor distribution zone is defined below the distribution plate and the shell has a vapor inlet for feeding a vapor stream into the vapor distribution zone.

19. The heat exchanger of claim 15, further comprising bar-shaped baffles secured inside the shell for preventing movement of the tubes.

20. The heat exchanger of claim 15, further comprising a liquid overflow pipe passing through the sparger plate.

21. The heat exchanger of claim 15, wherein the tubes are spaced into a plurality of sections with raceways being defined between the sections and further comprising liquid distribution shrouds, one shroud encircling each section.

22. The heat exchanger of claim 21, wherein the shrouds have a lower end secured to the sparger plate and have holes through which the liquid stream may pass.

23. A process for exchanging heat between first and second fluids using a vertical falling film shell and tube heat exchanger, the heat exchanger having a cross-section, the second fluid having at least two components, the second fluid having a liquid portion and a vapor portion, the process comprising:

passing the first fluid through a plurality of vertical, parallel tubes, the tubes having an outer surface;

feeding the liquid portion of the second fluid to a liquid distribution zone defined within the shell;

feeding the vapor portion of the second fluid to a vapor distribution zone defined within the shell;

distributing the liquid portion a first time along the cross-section of the heat exchanger;

distributing the liquid portion a second time along the cross-section of the heat exchanger; and forming a thin falling film of the liquid portion on the outer surface of the tubes.

24. The process of claim 23, wherein the vapor portion comprises ammonia and water.

25. The process of claim 24, wherein the vapor portion contains more ammonia than water on a weight basis.

26. The process of claim 24, further comprising absorbing the vapor portion into the liquid portion.

27. The process of claim 24, wherein the vapor portion is richer in ammonia than the liquid portion.

28. The process of claim 26, wherein the first and second fluids have outlet temperatures and the outlet temperature of the second fluid is lower than the outlet temperature of the first fluid.

* * * * *